US006958597B1

(12) United States Patent
Lin et al.

(10) Patent No.: US 6,958,597 B1
(45) Date of Patent: Oct. 25, 2005

(54) VOLTAGE GENERATING APPARATUS WITH A FINE-TUNE CURRENT MODULE

(75) Inventors: Hong-chin Lin, Taipei (TW); Po-Hsuan Huang, Taipei Hsien (TW); Chien-Hung Ho, Hsin-Chu (TW)

(73) Assignee: eMemory Technology Inc., Hsin-Chu (TW)

( * ) Notice: Subject to any disclaimer, the term of this patent is extended or adjusted under 35 U.S.C. 154(b) by 29 days.

(21) Appl. No.: 10/709,470

(22) Filed: May 7, 2004

(51) Int. Cl.[7] ..... G05F 3/16
(52) U.S. Cl. ..... 323/313; 323/315; 323/907
(58) Field of Search ..... 323/313, 314, 323/315, 316, 907

(56) References Cited

U.S. PATENT DOCUMENTS 6,201,381 B1 * 3/2001 Yasuda ..... 323/315
6,563,295 B2 * 5/2003 Juang ..... 323/315
6,737,849 B2 * 5/2004 Eshraghi et al. ..... 323/315

* cited by examiner

*Primary Examiner*—Adolf Berhane
(74) *Attorney, Agent, or Firm*—Winston Hsu

(57) ABSTRACT

Voltage generating apparatus includes a positive temperature coefficient current generating module, a negative temperature coefficient current generating module, a fine-tune current module and a voltage output module. The function of the positive temperature coefficient current generating module and the negative temperature coefficient current generating module, which take advantage of characteristics of MOS devices operated in the sub-threshold region, is to generate a stable current of positive temperature coefficient and a stable current of negative temperature coefficient, respectively. The current fine-tune module increases or decreases output current of the negative temperature coefficient current generating module. The voltage output module sums two output currents of the positive temperature coefficient current generating module and the negative temperature coefficient current generating module and transforms the total current into output voltage that is stable under temperature and process variation.

16 Claims, 18 Drawing Sheets

VOLTAGE GENERATING APPARATUS WITH A FINE-TUNE CURRENT MODULE

BACKGROUND OF INVENTION

1. Field of the Invention

The present invention relates to a voltage generating apparatus, more particularly, to a voltage generating apparatus with a fine-tune current module.

2. Description of the Prior Art

Almost all analog or mixed-mode circuits need reference voltages to provide the bias voltage. The reference voltage can generate a constant and reproducible voltage even during process variation, change of ambient temperature, and supply voltage instability so that the circuits can operate with accurate DC bias. Therefore, a DC voltage generator is an important block in many circuits.

A well-known method of generating a stable reference voltage is to utilize the phenomenon of semiconductor bandgap in a reference circuit. The bandgap energy of a semiconductor will change predictably with ambient temperature, and bandgap reference circuits are designed according to this principle. The most popular method of generating bandgap voltage in the prior art is to connect the base and the collector of a BJT to form a diode-like structure, so the voltage difference (Vsub) between the base and the emitter of the BJT can be the bandgap voltage.

Please refer to FIG. 1. FIG. 1 illustrates temperature variation versus Vsub in a diode-like device. As shown in FIG. 1, Vsub linearly decreases with rising temperature. If one can generate another voltage (like the compensation voltage in FIG. 1) which linearly increases with rising temperature at the same rate as Vsub decreases, the summation of the two voltages results in a constant reference voltage that reduces variation due to temperature.

Please refer to FIG. 2. FIG. 2 illustrates a reference voltage generator 200 implementing the bandgap voltage principle. The reference voltage generator 200 is a feedback control system that maintains two inputs of the amplifier 230 at similar levels. In the reference voltage generator 200, the diodes D1 and D2 have different section areas corresponding to different current densities in order to adjust the slopes of the temperature coefficients of the two diodes, D1 and D2. When the voltage generator 200 is operating, the voltage difference of VD1 and VD2 (Vdel) expresses a characteristic of a positive temperature coefficient (a positive slope in the temperature function), but the voltage VD1 expresses a characteristic of a negative temperature coefficient, like the property of an ordinary semiconductor. Through the combination and arrangement of the diodes D1, D2 and the amplifier 230, the amplifier 230 will output a stable voltage regulated against temperature variation resulting from compensation of the voltage with the positive temperature coefficient, and the voltage with the negative temperature coefficient. However, in the modern IC industry, more mature CMOS technology achieves lower production costs. Thus, the reference voltage generator in FIG. 1 implemented by BJTs has the disadvantage of higher price compared to some products. Moreover, the bandgap of silicon, being about 1.2V to 1.3V, cannot satisfy future trends in low power applications.

Due to lower costs and more mature technology, a voltage generator of another prior art is implemented by MOSFETs. In this case, the voltage is generated by operating a MOS device in the sub-threshold region.

When a MOS device is operating in the sub-threshold region, if the device is given a fixed drain current, the voltage difference between the gate and the source of the device will linearly decrease with an increase of ambient temperature. In other words, the voltage difference shows a negative temperature coefficient in this situation. Please refer to FIG. 3; FIG. 3 illustrates a voltage generator 300 utilizing the negative temperature coefficient of a MOS device according to the prior art. The voltage generator 300 has two parts. The first part includes MOS MM1 to MOS MM4, and a resistor R1, wherein the MOS MM1 is designed to operate in the sub-threshold region and the current IRR1 through the resistor RR1 relates to the voltage difference between the gate and the source of the MOS MM1. The second part includes MOS MM5 to MOS MM11 and the resistors RR2, RR3 and RR4. The second part generates an output voltage VR by compensating the current IRR1 of a negative temperature coefficient and a current of a positive temperature coefficient. The voltage generating method not only has lower production costs but also can generate a lower reference voltage to provide a small voltage bias for low power circuits.

However, the prior art in FIG. 3 has the disadvantage that although the generated voltage is stable with respect to temperature variation, the actual voltage output of the circuit will deviate from the design value due to processing variation. Therefore, the voltage generators in the second prior art have different output voltages if implemented by different process corners.

SUMMARY OF INVENTION

It is therefore an objective of the claimed invention to provide a voltage generator in order to solve the abovementioned problems.

According to the claimed invention, a voltage generator comprises a positive temperature coefficient current generating module, wherein an output current of the positive temperature coefficient current generating module increases with a rising ambient temperature; a negative temperature coefficient current generating module, wherein an output current of the positive temperature coefficient current generating module decreases with rising ambient temperature; a current fine-tune module used for adjusting the output current of the negative temperature coefficient current generating module; and a voltage output module, connected to the positive temperature coefficient current generating module and the negative temperature coefficient current generating module for generating an output voltage according to the positive temperature coefficient current generating module and the negative temperature coefficient current generating module.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
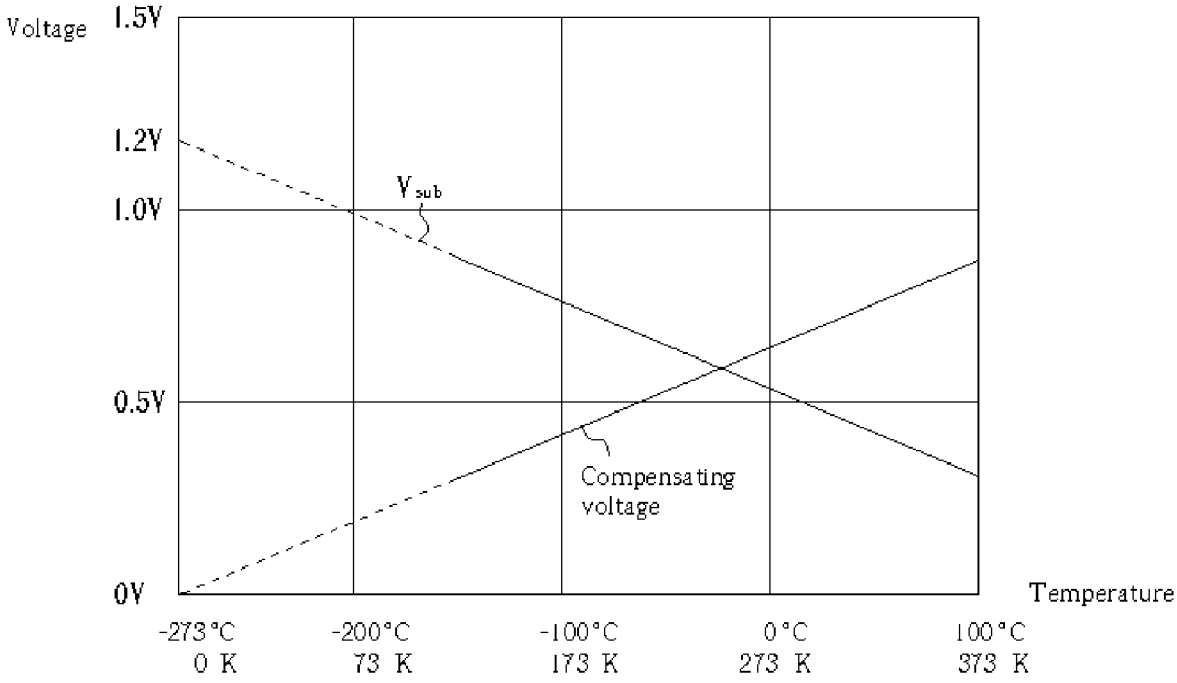
Fig. 1 Prior art
FIG. 1 illustrates temperature variation versus Vsub in a diode-like device.
Figure 2:
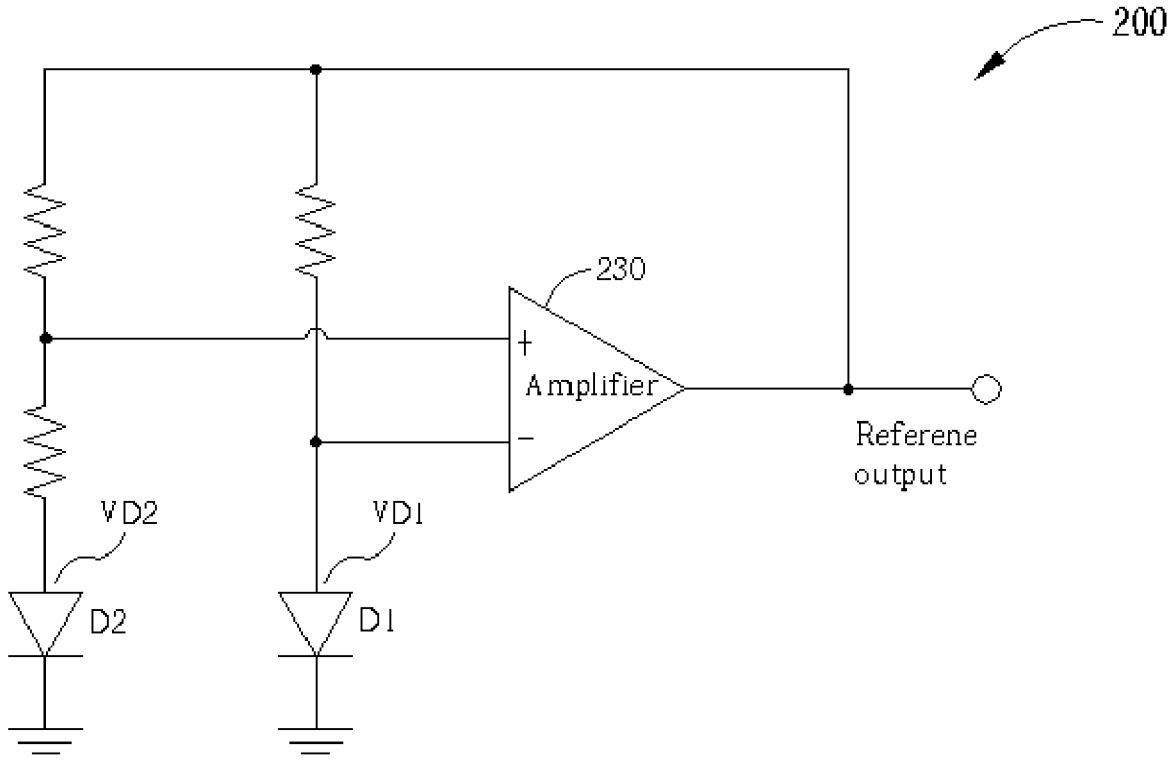
Fig. 2 Prior art
FIG. 2 illustrates a reference voltage generator implementing the bandgap voltage principle.
Figure 3:
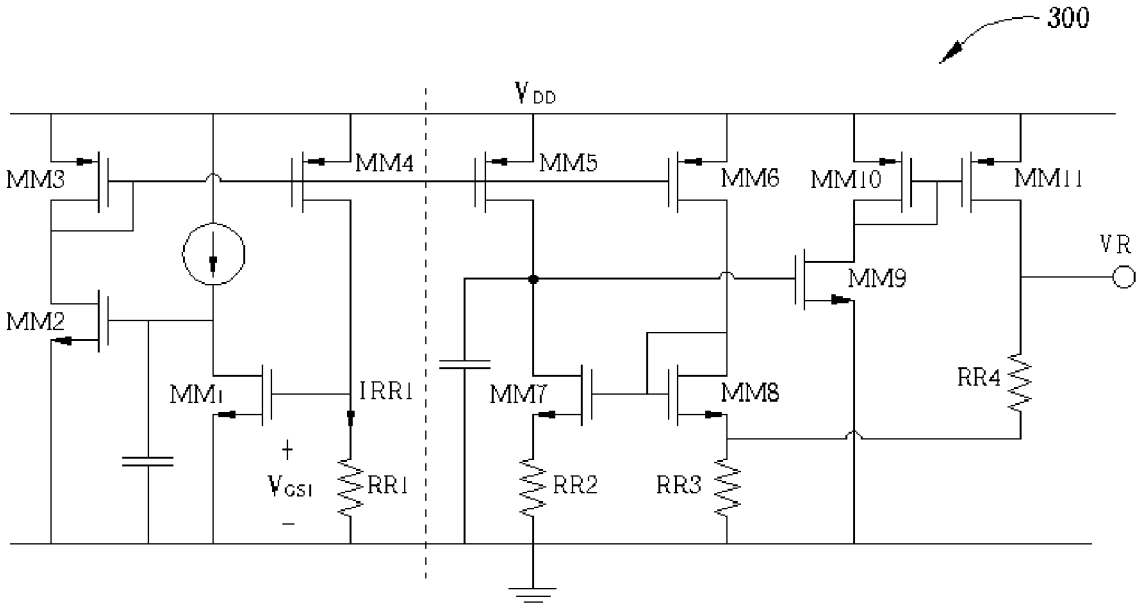
Fig. 3 Prior art
FIG. 3 illustrates a voltage generator utilizing the negative temperature coefficient of a MOS device according to the prior art.
Figure 4:
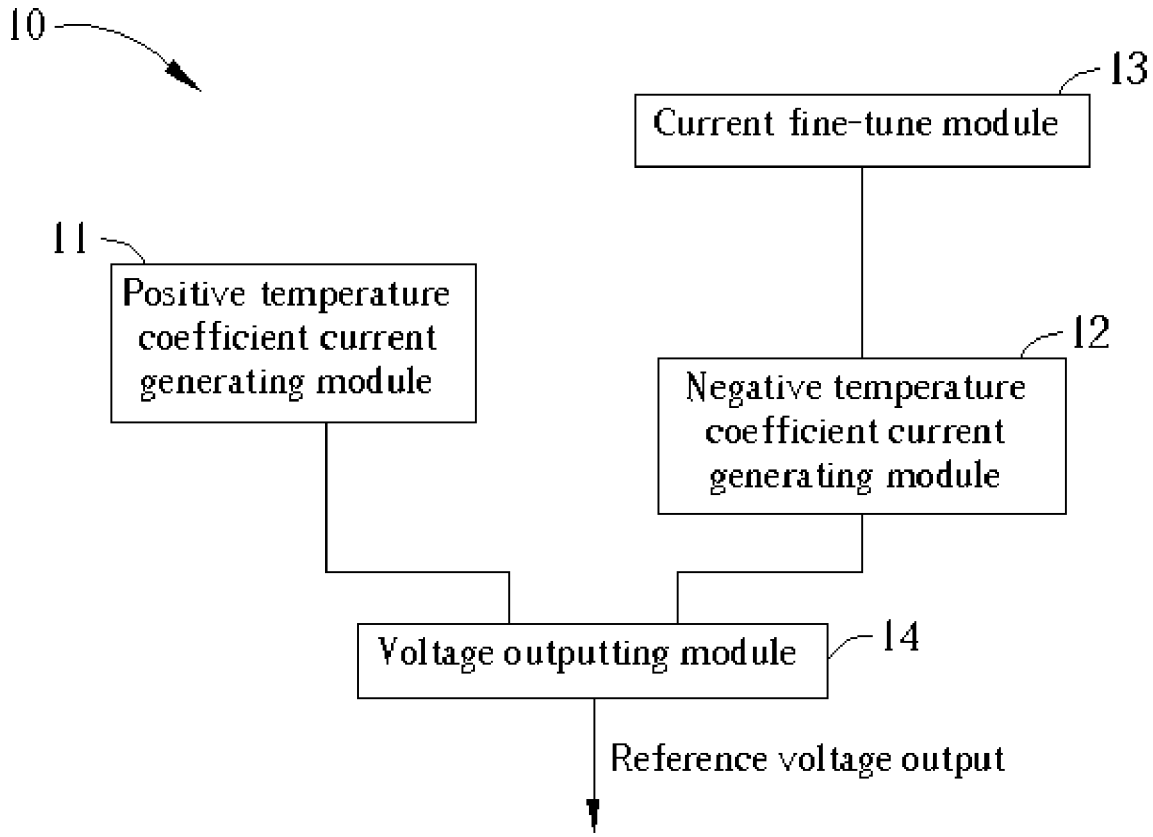
FIG. 4 illustrates function blocks of a voltage generator according to the present invention.

Please refer to FIG. 4. FIG. 4 illustrates function blocks of a voltage generator 10 according to the present invention. The voltage generator 10 comprises a positive temperature coefficient current generating module 11, a negative temperature coefficient current generating module 12, a current fine-tune module 13, and a voltage output module 14. The positive temperature coefficient current generating module 11 is used to generate a current of a positive temperature coefficient (a current of a positive temperature coefficient means that when the ambient temperature rises, the current will increase, wherein the increasing slope of the current is the positive temperature coefficient). The negative temperature coefficient current generating module 12 is used to generate a current of negative temperature coefficient (Similarly, a current of a negative temperature coefficient means that when the ambient temperature rises, the current will decrease, wherein the decreasing slope of the current is the negative temperature coefficient). The current fine-tune module 13 is used to adjust the output current of the negative temperature coefficient current generating module 12. The voltage output module 14, being connected to two temperature coefficient current generating modules, is used to generate an output voltage according to the output current of the two temperature coefficient current generating modules.

Figure 5:
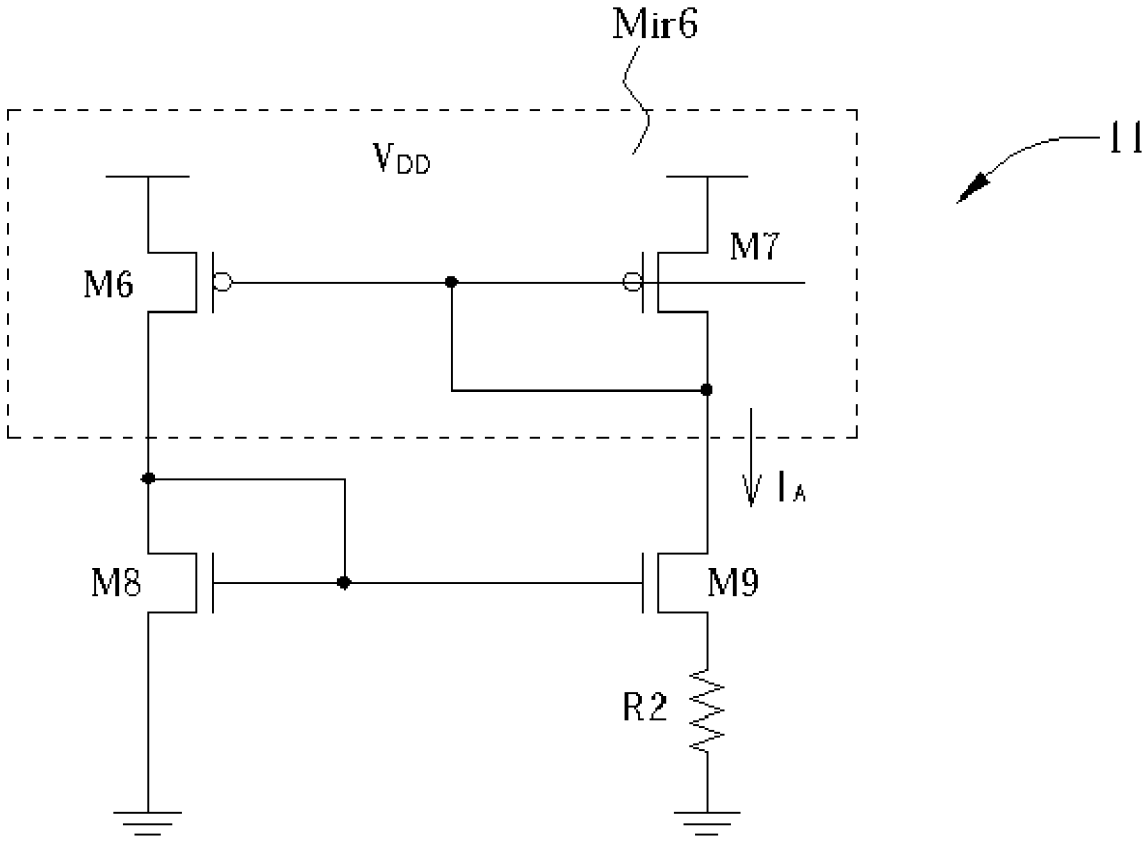
FIG. 5 illustrates one embodiment of the positive temperature coefficient current generating module.

FIG. 5 illustrates one embodiment of the positive temperature coefficient current generating module 11. In this embodiment, the positive temperature coefficient current generating module 11 comprises NMOS M8 and M9, resistor R2 and a current mirror Mir6. The drain and the gate of NMOS M8 are connected to the gate of MOS M9 and the source of NMOS M8 is connected to ground. The source of NMOS M9 is connected to ground through resistor R2. Both the drains of NMOS M8 and NMOS M9 are connected to current mirror Mir6. The current $I_A$ through the drain of MOS M9 is the current of the positive temperature coefficient. The current mirror Mir6 comprises PMOS M6 and M7. PMOS M6 and M7 not only help NMOS M8 and NMOS M9 operate in the sub-threshold region, but also generate a current that is some multiple of the current $I_A$. In the circuit of FIG. 5, NMOS M8 and M9 are operated in the sub-threshold region so that the drain currents of NMOS M8 and M9 are stable and regulated against variation of the power supply. The magnitude of the current $I_A$ relates to the ratio W/L of MOS M8 and MOS M9 (W and L are the width and the length of a MOS, respectively). The current $I_A$ is also a function of the resistor R2. For example, if we define the W/L of NMOS M8 and NMOS M9 as $P_8$ and $P_9$ respectively. The output current $I_A$ can be expressed in the following:

$$I_A = \frac{\varsigma V_T}{R_2}\ln\left(\frac{P_9}{P_8}\right)$$

wherein $V_T$ is a coefficient proportional to the absolute temperature, and $\zeta$ is a ratio constant related to the characteristic of a MOS device operating in the sub-threshold region. From above we know that the current $I_A$ is decided by the resistor R2 and W/L of NMOS M8 and M9 and is proportional to the ambient absolute temperature. Therefore, the output current $I_A$ is a current of a positive temperature coefficient.

Figure 6:
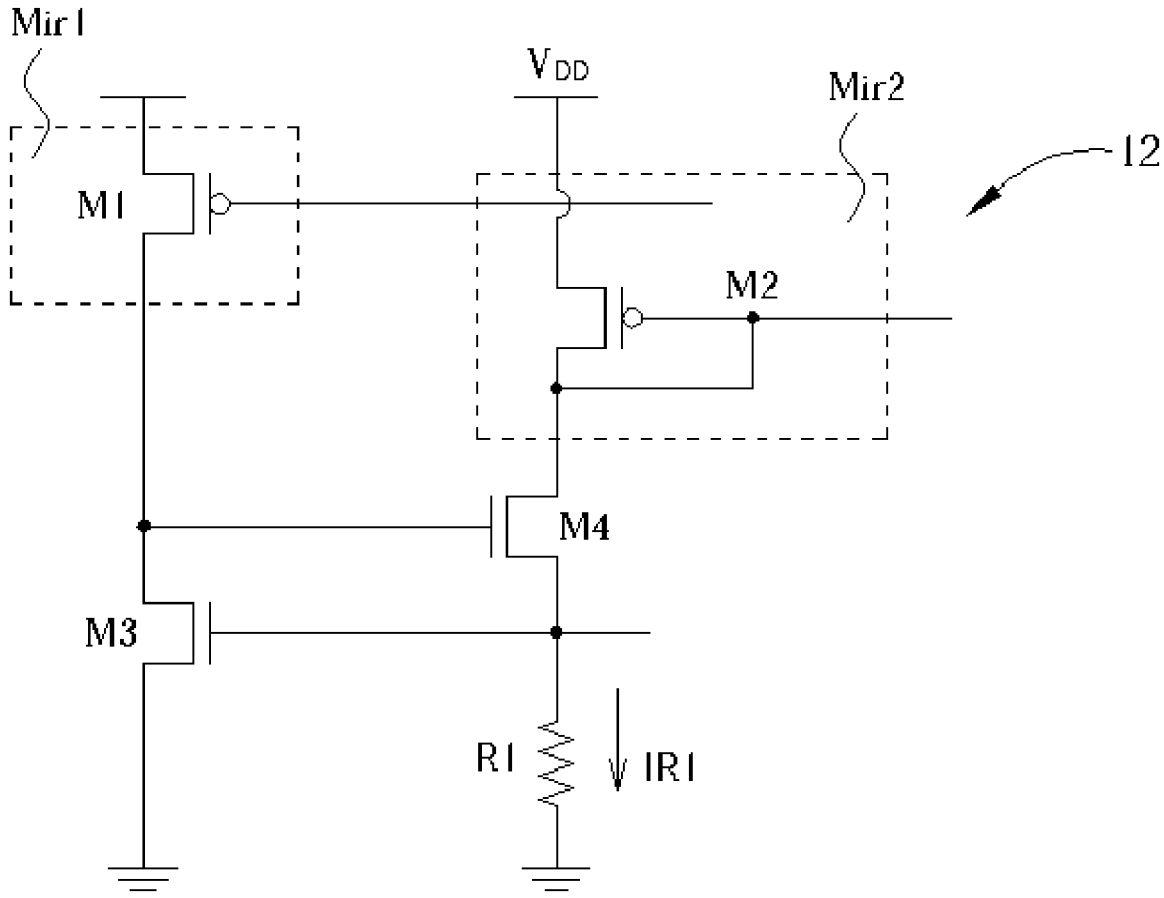
FIG. 6 illustrates one embodiment of the negative temperature coefficient current generating module.

Please refer to FIG. 6. FIG. 6 illustrates one embodiment of the negative temperature coefficient current generating module 12. The negative temperature coefficient current generating module 12 comprises an NMOS M3, a resistor R1, current mirrors Mir1 and Mir2. The gate of NMOS M3 is connected to one end of resistor R1 and the other end of resistor R1 is connected to ground. The source of NMOS M3 is connected to ground and the drain of NMOS M3 is connected to current mirror Mir1. The current mirror Mir1, comprising a PMOS M1, is used to mirror an outside reference current and inject a current output into NMOS M3. The injection current should be small enough to force NMOS M3 to operate in the sub-threshold region, so the voltage VGS3 between the gate and the source of NMOS M3 is constant for a fixed temperature. The voltage VGS3 is representative of a negative temperature coefficient and can generate a current of the negative temperature coefficient, i.e. the output current of the negative temperature coefficient current generating module when applied to the resistor R1. The current mirror Mir2, comprising a PMOS M2, can mirror the output current IR1 to generate a current that is some multiple of the current IR1. In the preferred embodiment of the negative temperature coefficient current generating module 12, the outside reference current that the current mirror Mir1 mirrors is the output current $I_A$ of the positive temperature coefficient current generating module 11. The output current $I_A$ is utilized to avoid the need for an extra circuit for generating a reference current.

Figure 7:
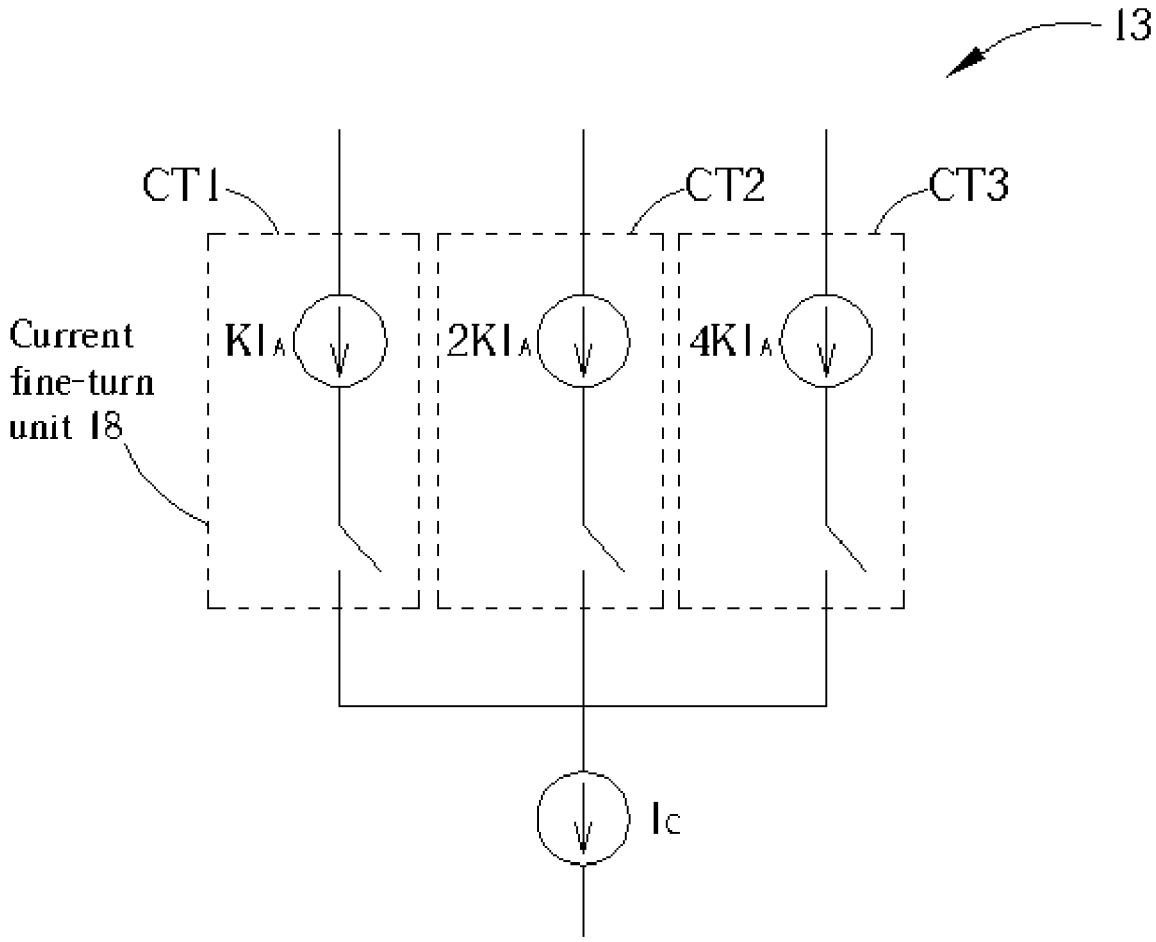
FIG. 7 illustrates a current fine-tune module.

Please refer to FIG. 7. FIG. 7 illustrates a current fine-tune module 13. The current fine-tune module comprises at least one fine-tune unit 18 and the adjusting ability of each fine-tune unit 18 is freely set. The fine-tune unit 18 comprises a current source and a switch. In the embodiment, the current fine-tune module 13 comprises three fine-tune units, the fine-tune unit CT1, the fine-tune unit CT2, and the fine-tune unit CT3. The current source of the fine-tune unit CT1 is designed to be 'K' times the output current $I_A$ (of the positive temperature coefficient current generating module), wherein K is a constant. The current source of the fine-tune unit CT2 is designed as 2K times the output current $I_A$ and the current source of the fine-tune unit CT3 is designed as $4KI_A$. The current of the three fine-tune units is summed to form the output current $I_C$ of the current fine-tune module.

The switch of each fine-tune unit digitally controls the output current $I_C$. Therefore, the current $I_C$ of the embodiment ranges from 0 to $7KI_A$ in increments of $1KI_A$. Of course, the number of fine-tune units is not limited to three. If there are N fine-tune units, for example, the output current $I_C$ of the current fine-tune module will range from 0 to $(2_N-1)KI_A$ with in increments of $1I_A$. The current source of the embodiment is implemented by the current mirror of an NMOS device or a PMOS device, which mirror the output current I to generate a current of some multiple of the current $I_A$. However, the current source can be implemented in other ways.

Figure 8:
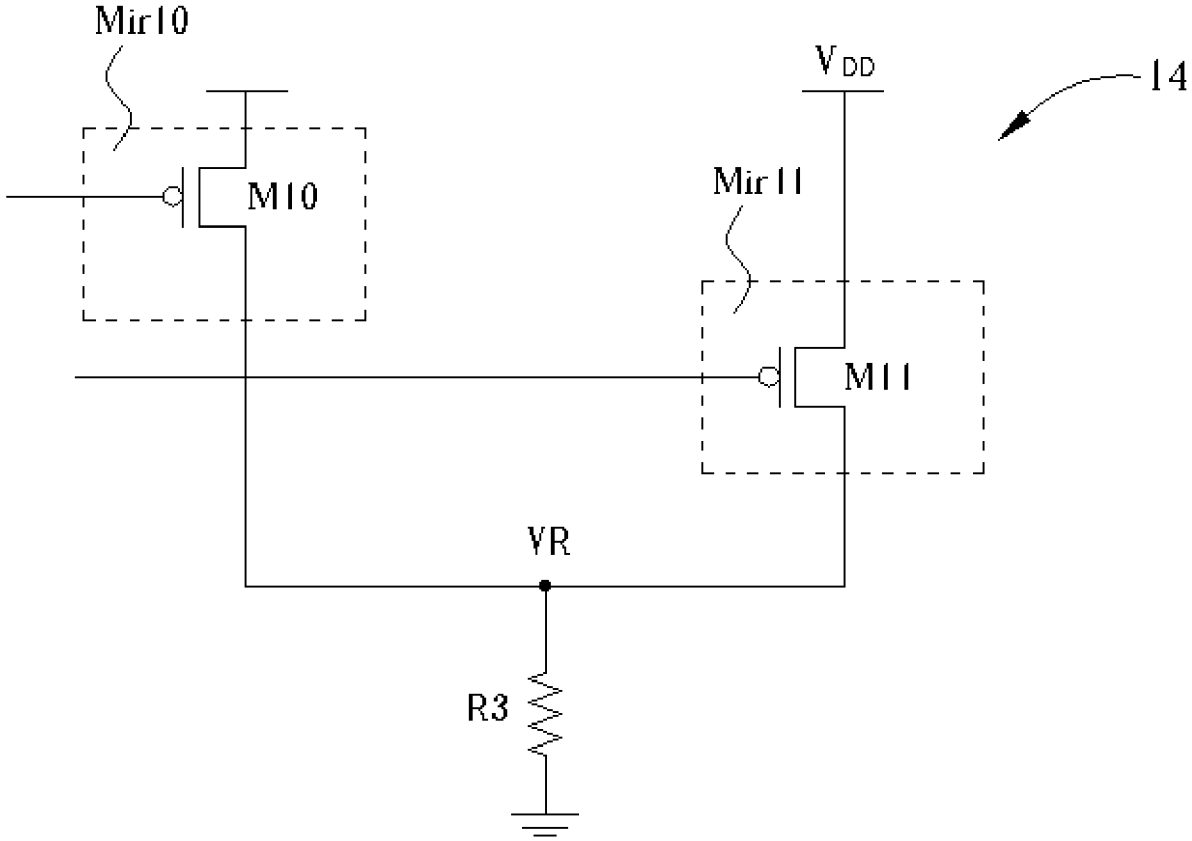
FIG. 8 illustrates the voltage output module.

Please refer to FIG. 8. FIG. 8 illustrates the voltage output module 14. The voltage output module 14 comprises current mirrors Mir10 and Mir11 and a resistor R3. Current mirror Mir10 comprises a PMOS M10 and current mirror Mir11 comprises a PMOS M11. The sources of PMOS M10 and M11 are connected to the power supply $V_{DD}$, and the drains are connected to one end of the resistor R3, the node VR shown in FIG. 8. The other end of the resistor R3 is connected to ground. The current mirrors Mir10 and M11 mirror the output currents of the positive temperature coefficient current generating module 11 and the negative temperature coefficient current generating module 12 respectively with some multiple, the two mirrored currents are summed and injected into the resistor R3 to obtain the output voltage of the voltage output module 14 at the node VR.

Figure 9:
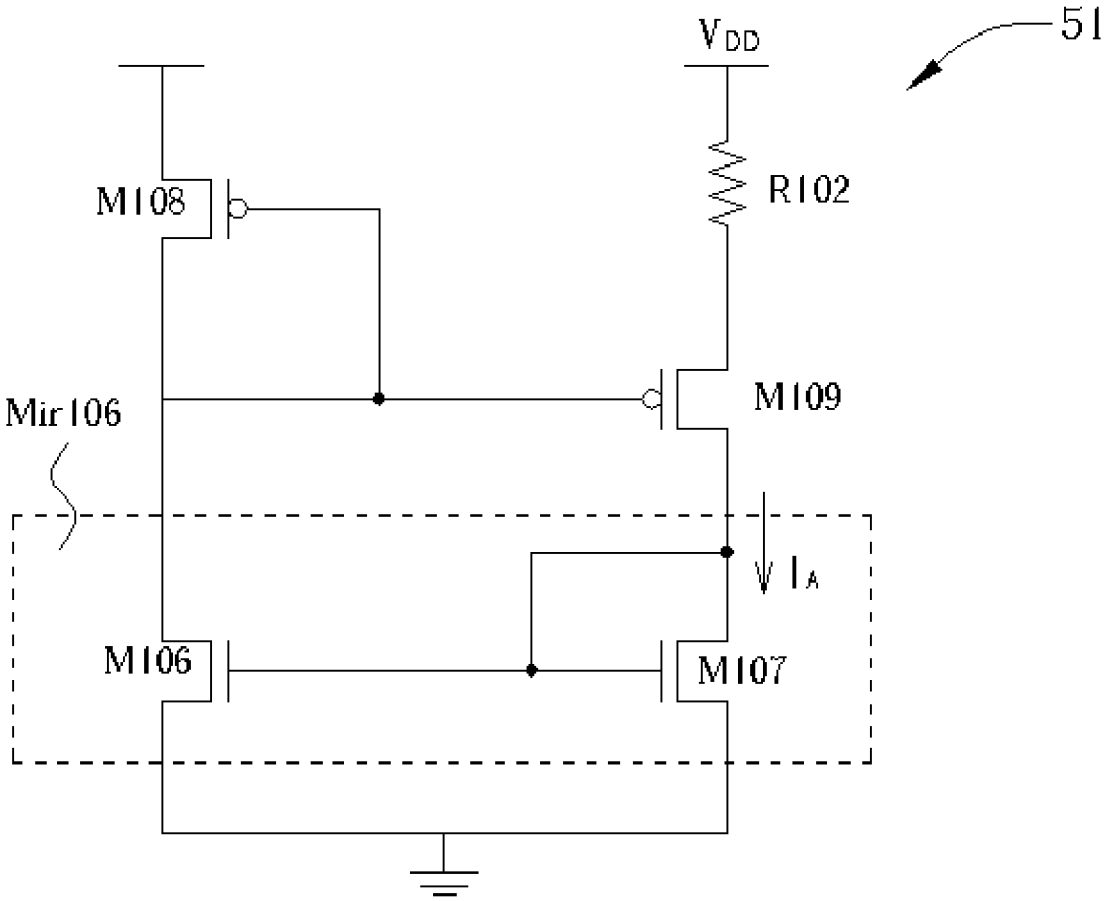
FIG. 9 illustrates a positive temperature coefficient current generating module.

Please refer to FIG. 9. FIG. 9 illustrates a positive temperature coefficient current generating module 51. The positive temperature coefficient current generating module 51 comprises PMOS M108 and M109, a resistor R102 and a current mirror Mir106. The source and the gate of PMOS M108 and M109 are connected together. The source of MOS 108 is connected to the power supply $V_{DD}$. The source of MOS M109 is connected to the power supply $V_{DD}$ through resistor R102. The drains of MOS M108 and MOS M109 are connected to the current mirror Mir106. The current $I_A$ through the drain of the PMOS M109 is an output current of positive temperature coefficient. The current mirror Mir106 comprises NMOS M106 and M107. As mentioned before, NMOS M106 and M107 help PMOS M108 and M109 operate in the sub-threshold region and generate a current that is a multiple of the current $I_A$. If we define the ratio W/L of MOS M108 and M109 as $P_{108}$ and $P_{109}$, respectively, the output current $I_A$ can be expressed by the following equation:

$$I_A = \frac{\varsigma V_T}{R_2}\ln\left(\frac{P_{109}}{P_{108}}\right)$$

Figure 10:
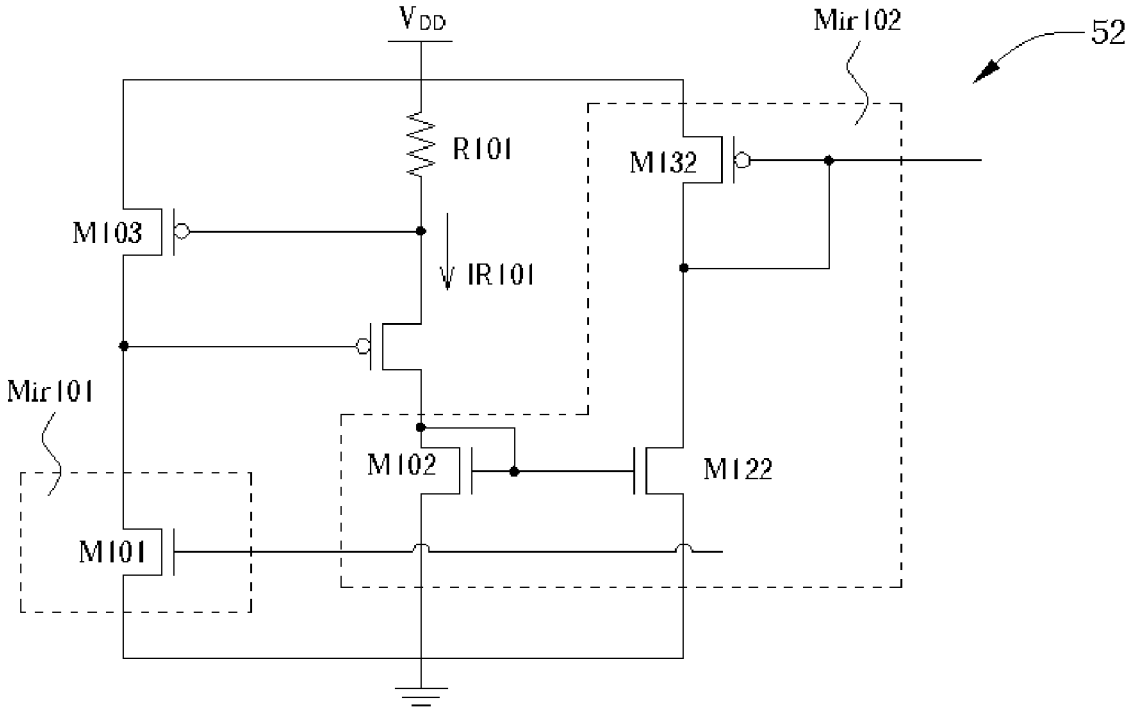
FIG. 10 illustrates a negative temperature coefficient current generating module.

Please refer to FIG. 10. FIG. 10 illustrates a negative temperature coefficient current generating module 52. The negative temperature coefficient current generating module 52 comprises a PMOS M103, a resistor R101, current mirrors Mir101 and Mir102. The gate of PMOS M103 connects to one end of resistor R101 and the other end of the resistor R1 is connected to $V_{DD}$. The source of PMOS M103 is connected to ground and the drain of PMOS M103 is connected to current mirror Mir101. Current mirror Mir101, comprising an NMOS M101, is used to mirror an outside reference current and inject an output current into PMOS M103 to force PMOS M103 to operate in the sub-threshold region. The current through resistor R101 is representative of a negative temperature coefficient. The current mirror Mir102 comprises an NMOS M102, na NMOS M122, and a PMOS M132 to generate a current that is some multiple of the current IR101.

Figure 11:
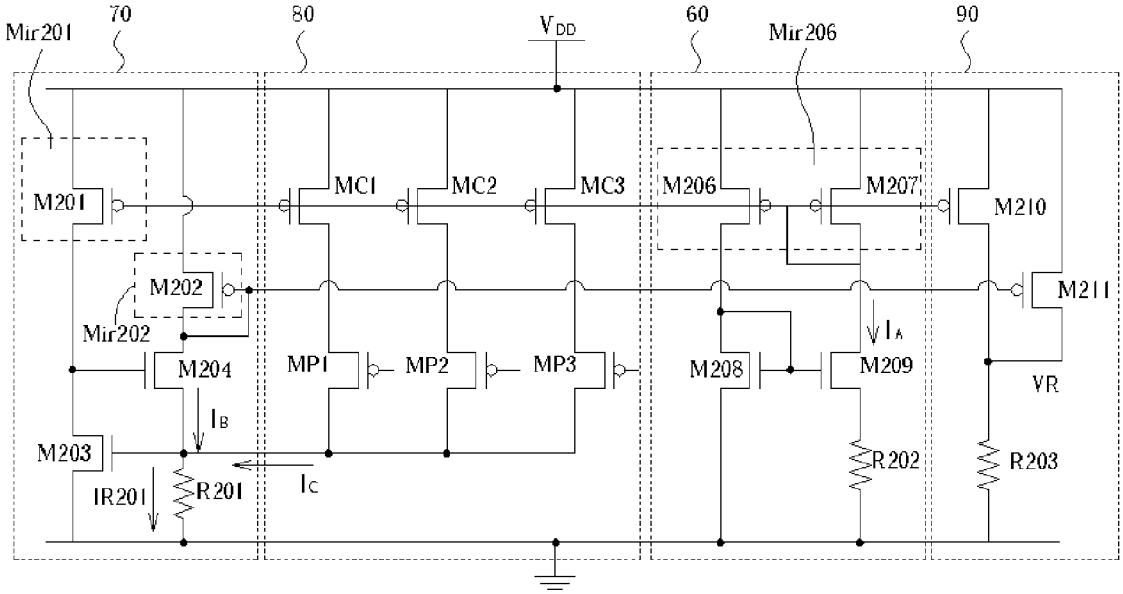
FIG. 11 illustrates the preferred embodiment of a voltage generator according to the present invention.

Please refer to FIG. 11. FIG. 11 illustrates the preferred embodiment of a voltage generator according to the present invention. The voltage generator comprises a positive temperature coefficient current generating circuit 60, a negative temperature coefficient current generating circuit 70, a current fine-tune circuit 80, and a voltage outputting circuit 90. The positive temperature coefficient current generating circuit 60 comprises NMOS M208 and M209, a resistor R2 and a current mirror Mir206. The drain and gate of NMOS M208 are connected to the gate of MOS M209 and the source of NMOS M208 is connected to ground. The source of NMOS M209 is connected to ground through resistor R202. The drain current of NMOS M209 passes through the current mirror Mir206, generating an output current $I_A$ being representative of a positive temperature coefficient. Both NMOS M208 and M209 operate in the sub-threshold region so that the output current $I_A$ from the drain of MOS M203 is regulated against variation of the power supply. The current mirror Mir206 comprises PMOS M206, M207 and M207, and is used to mirror the output current $I_A$ with some multiple to other blocks of the voltage generator.

The negative temperature coefficient current generating circuit 70 comprises an NMOS M203, a resistor R201, current mirrors Mir201 and Mir202. The gate of NMOS M203 connects to one end of the resistor R201 and the other end of the resistor R201 is connected to ground. The source of NMOS M203 is also connected to ground. The current mirror Mir201 mirrors the current $I_A$ and injects it into the drain of NMOS M203 to force NMOS M203 to operate in the sub-threshold region. Therefore, the current through the resistor R201 is a current representative of a negative temperature coefficient. The purpose of the current mirror Mir202 is to mirror the output current of the negative temperature coefficient current generating circuit 70 to the voltage outputting circuit 90. If the negative temperature coefficient current generating circuit 70 is not equipped with the current fine-tune circuit 80 to fine tune the output current, the current mirror Mir202 would directly mirror the output current IR1. However, in the embodiment, the negative temperature coefficient current generating circuit 70 is combined with the current fine-tune circuit 80 to generate the output current $I_B$ (as shown in FIG. 6). Therefore, the current mirror Mir202 mirrors the current $I_B$. The current $I_B$ relates to the current $I_C$ and IR1 in FIG. 11 and will be explained in detail below.

The current fine-tune circuit 80 can comprise three fine-tune units. The first fine-tune unit comprises PMOS MP1 as a switch, and PMOS MC1 as a current source. The second fine-tune unit comprises PMOS MP2 as a switch, and PMOS MC2 as a current source. The third fine-tune unit comprises PMOS MP3 as a switch, and PMOS MC3 as a current source. PMOS MC1, MC2, and MC3 act like current mirrors, mirroring the output current $I_A$ of the positive temperature coefficient current generating circuit 60 with some multiple. Therefore, in the current fine-tune circuit 80, the first fine-tune unit provides fine-tune current $1K\,I_A$, wherein K is the ratio of W/L of two MOS devices in the current mirror, such as the ratio of MOS M207 W/L $P_{207}$ and MC1 W/L $P_{MC1}$, $$\frac{MC1}{M_{207}}$$

The second fine-tune unit provides the fine-tune current $2KI_A$, and the third fine-tune unit provides fine-tune current $4KI_A$. The three fine-tune currents are summed as an output current $I_C$. Controlled digitally by the switches MP1, MP2 and MP3. The current $I_c$ can be tuned to 0, $1KI_A$, $2KI_A$, $3KI_A$, $4KI_A$, . . . $7KI_A$. To describe in detail, suppose that W/L of PMOS M207 in the positive temperature coefficient current generating circuit 60 is $P_{207}$, and W/L of three current sources in the current fine-tune circuit are $P_{C1}$, $P_{C2}$, and $P_{C3}$, respectively. The current $I_C$ can be expressed as follows:

$$I_C = \left(\frac{P_{C1}}{P_{207}}\phi_1 + \frac{P_{C2}}{P_{207}}\phi_2 + \frac{P_{C3}}{P_{207}}\phi_3\right)I_A, \text{ and } \phi_1, \phi_2, \phi_3$$

are 1 or 0 that represents on or off condition of a switch. The negative temperature coefficient current generating circuit 70 combined with the current fine-tune circuit 80 is used to fine decrease the output current $I_B$ of the negative temperature coefficient current generating circuit 70, wherein the currents $I_B$, $I_C$ and IR1 will satisfy the following relationship:

$$I_B = IR201 - I_C$$

Therefore, the increase of the current $I_C$ will decrease the output current $I_B$ to achieve the function of fine-tuning.

The voltage outputting circuit 90 connected to the positive and the negative temperature coefficient current generating circuits 60, 70 comprises PMOS M210, PMOS M211 and resistor R203 and generates an output voltage VR according to the output currents of the positive and the negative temperature coefficient current generating circuits 60, 70. PMOS M210 and M211 act like current mirrors, wherein PMOS M211 mirrors the output current $I_A$ of the positive temperature coefficient current generating circuit 60 and PMOS M210 mirrors the output current $I_B$ of the negative temperature coefficient current generating circuit 70. Two mirrored currents are summed to form an output voltage VR through the resistor R203. Suppose that P represents W/L of a MOS device. Therefore, $P_{201}$ represents W/L of PMOS M201 and $P_{209}$ represents W/L of PMOS M209, and vice versa. Set $$N = \left(\frac{P_{C1}}{P_{207}}\phi_1 + \frac{P_{C2}}{P_{207}}\phi_2 + \frac{P_{C3}}{P_{207}}\phi_3\right),$$

wherein VGS203 represents the voltage between the gate and the source of NMOS M203. We can obtain the expression of output voltage V:

$$V_R = \frac{P_{211}}{P_{202}}\frac{R_{203}}{R_{201}}V_{GS203} + \left(\frac{P_{210}}{P_{207}} - N\frac{P_{211}}{P_{202}}\right)\frac{R_{203}}{R_{202}}\varsigma V_T \ln\left(\frac{P_{209}}{P_{208}}\right),$$

VR is determined by $$\frac{P_{210}}{P_{207}} *$$

$$\frac{R_{203}}{R_{202}} \text{ and } \frac{P_{211}}{P_{202}} *$$

$$\frac{R_{203}}{R_{201}},$$

so VR is easier to design by controlling the coefficient involved in the multiplication of $$\frac{P_{210}}{P_{207}} \text{ and } \frac{R_{203}}{R_{202}},$$

as well as the multiplication of $$\frac{P_{211}}{P_{202}} \text{ and } \frac{R_{203}}{R_{201}}.$$

Because N $$\frac{P_{211}}{P_{202}}$$

is the term for fine tuning, $$\frac{P_{210}}{P_{207}} >> N\frac{P_{211}}{P_{202}}.$$

Figure 12:
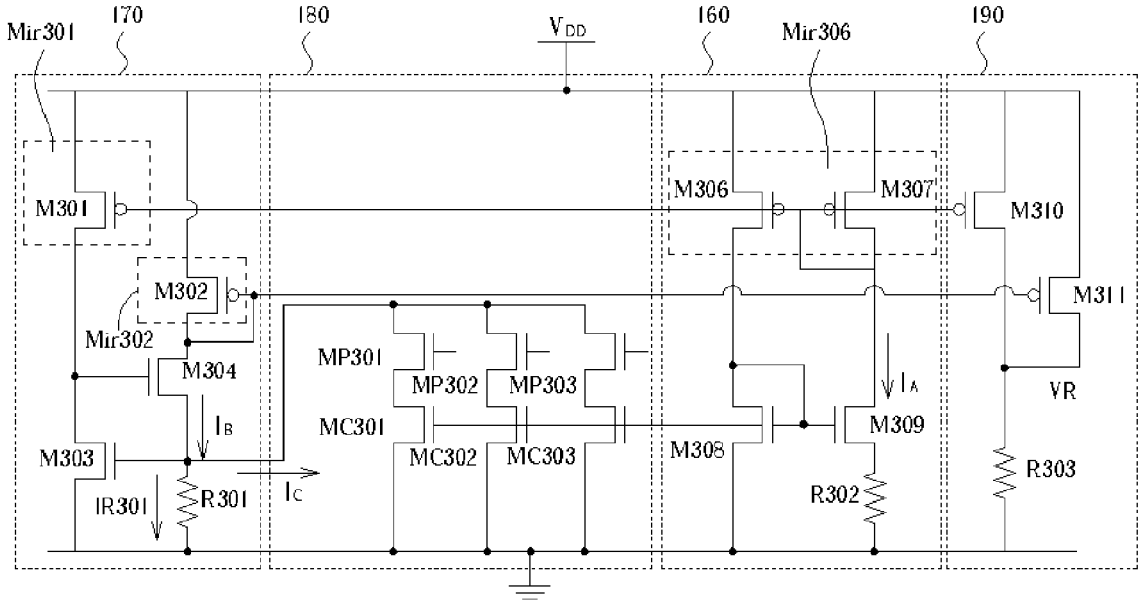
FIG. 12 illustrates another embodiment of the voltage generator according to the present invention.

Please refer to FIG. 12. FIG. 12 illustrates another embodiment of the voltage generator according to the present invention. The voltage generator comprises a positive temperature coefficient current generating circuit 160, a negative temperature coefficient current generating circuit 170, a current fine-tune circuit 180, and a voltage outputting circuit 190. In the embodiment, the principle of the current fine-tune circuit 180 is similar to the current fine-tune circuit 80 in FIG. 11. However, the current fine-tune circuit in FIG. 11 is used to fine decrease the output current of the negative temperature coefficient current generating circuit, but this embodiment is to fine increase the output current of the negative temperature coefficient current generating circuit. The current fine-tune circuit comprises three fine-tune units that are composed of three switches MC301, MC302 and MC303 as well as three NMOS MP301, MP302 and MP303 serving as the current sources. The gates of MOS MP301, MP302 and MP303 are connected to the gate of NMOS M309 of the positive temperature coefficient current generating circuit 160, so NMOS MP301, MP302, MP303 and NMOS M309 form three sets of current mirrors which generate three current sources in the current fine-tune circuit 180 according to the drain current $I_A$ of NMOS M309. Of course, the currents of the three fine-tune units can be designed as any multiple of a reference current. Finally, the currents of the three fine-tune units are summed to become the fine-tune current $I_C$ for effecting fine increases in the output current $I_B$ of the negative temperature coefficient current generating circuit 170. The current $I_B$ can be expressed in the following way:

$$I_B = IR301 + I_C$$

Figure 13:
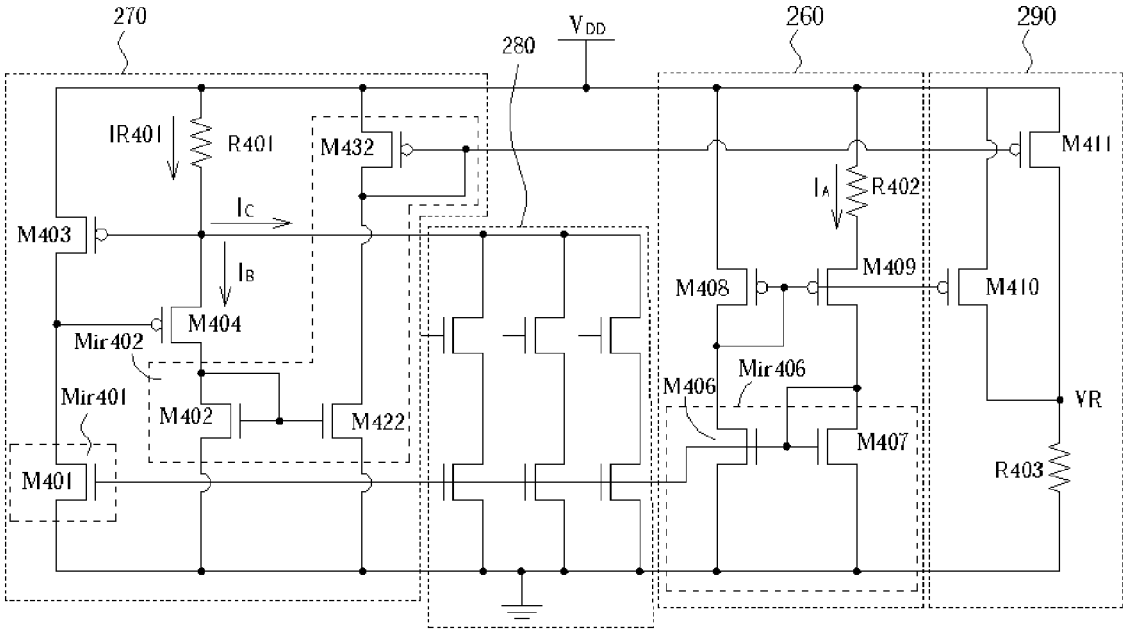
FIG. 13 illustrates another embodiment of the voltage generator according to the present invention.

Please refer to FIG. 13. FIG. 13 illustrates another embodiment of the voltage generator according to the present invention. The voltage generator comprises a positive temperature coefficient current generating circuit 260, a negative temperature coefficient current generating circuit 270, a current fine-tune circuit 280, and a voltage outputting circuit 290. The positive temperature coefficient current generating circuit 260 comprises PMOS M408, PMOS M409, resistor R402 and current mirror Mir406. The source and the gate of PMOS M408 and M409 are connected together. The source of MOS 408 is connected to the power supply $V_{DD}$. The source of MOS M109 is connected to the power supply $V_{DD}$ through resistor R402. Both PMOS M408 and M409 operate in the sub-threshold region, the output current $I_A$ of the positive temperature coefficient is generated by the drain of PMOS M409. The current mirror Mir406 comprises NMOS M406 and M407, which mirror the output current $I_A$ to other blocks of the voltage generator. The negative temperature coefficient current generating circuit 270 comprises PMOS M403, resistor R401, and two current mirrors Mir401 and Mir402. The gate of PMOS M403 connects to one end of resistor R401 and the other end of resistor R401 is connected to the supply $V_{DD}$. The source of NMOS M403 is also connected to the power supply $V_{DD}$. The current mirror Mir401 mirrors the current $I_A$ and injects it into the drain of PMOS M403 to force PMOS M403 to operate in the sub-threshold region. Therefore, the current through resistor R401 is a current representative of a negative temperature coefficient. In addition, the current mirror Mir402 comprises NMOS M402, NMOS M422 and PMOS M432, and mirrors the output current of the negative temperature coefficient current generating circuit 270 to the voltage outputting circuit 290.

The current fine-tune circuit 280 is similar to the current fine-tune circuit 180 in FIG. 12. In this embodiment, the current fine-tune circuit 280 is used to fine decrease the output current of the negative temperature coefficient current generating circuit 270 so that the output current $I_B$ of the negative temperature coefficient current generating circuit 270, and the output current $I_C$ of the current fine-tune circuit 280, satisfy the following relationship:

$$I_B = IR401 - I_C$$

The voltage outputting circuit 290, similar to the voltage outputting circuit 90 in FIG. 11, comprises a PMOS M410, a PMOS M411 and a resistor R403. The gate of PMOS M410 is connected to the gate of PMOS M409 of the positive temperature coefficient current generating circuit 260. The gate of PMOS M411 connected to the gate of PMOS M432 of the negative temperature coefficient current generating circuit 270 functions as a current mirror to mirror the output current $I_A$ of the positive temperature coefficient current generating circuit 260, and the output current $I_B$ of the negative temperature coefficient current generating circuit 270, to become two mirror currents and these two mirror currents are summed through resistor R403 to generate the output voltage VR.

Figure 14:
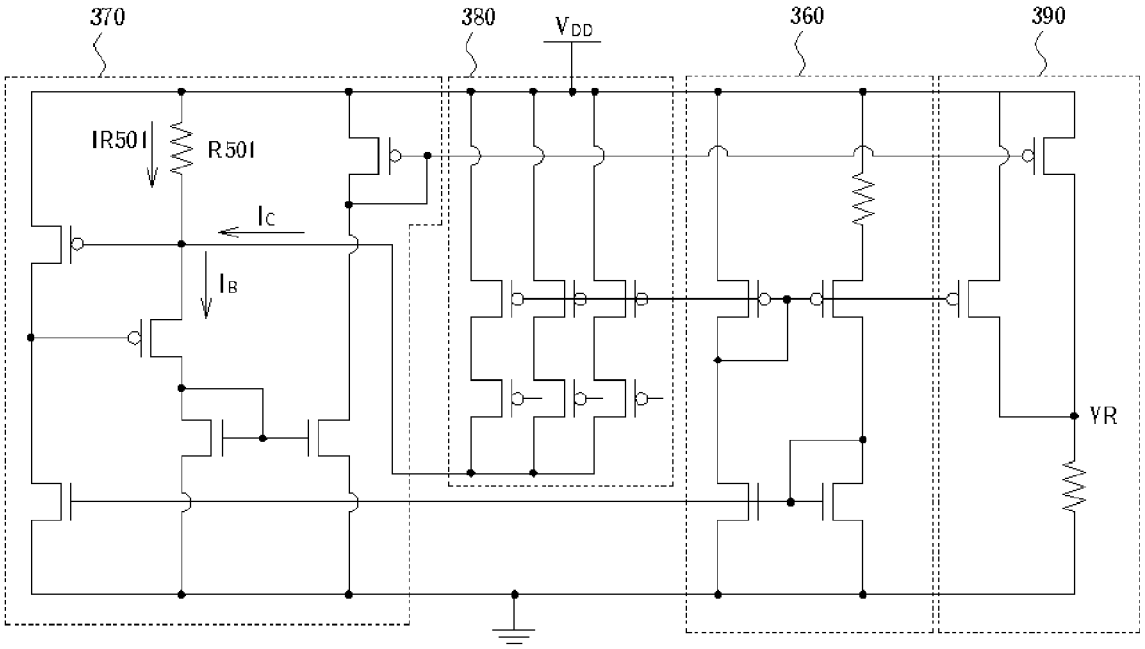
FIG. 14 illustrates another embodiment of the voltage generator according to the present invention.

Please refer to FIG. 14. FIG. 14 illustrates another embodiment of the voltage generator according to the present invention. The embodiment in FIG. 14 is similar to the embodiment in FIG. 13, wherein the voltage generator comprises a positive temperature coefficient current generating circuit 360, a negative temperature coefficient current generating circuit 370, a current fine-tune circuit 380, and a voltage outputting circuit 390. However, in this embodiment, the current fine-tune circuit 380 is used to fine increase the output current of the negative temperature coefficient current generating circuit 370, instead of fine decreasing the output current in the embodiment of FIG. 13. The structure and the principle of the current fine-tune circuit 380 is similar to the current fine-tune circuit 70 in FIG. 11. The output current $I_C$ generated by the current fine-tune circuit 380 and the output current $I_B$ generated by the negative temperature coefficient current generating circuit 370 have the following relationship:

$$I_B = IR501 + I_C$$

Figure 15:
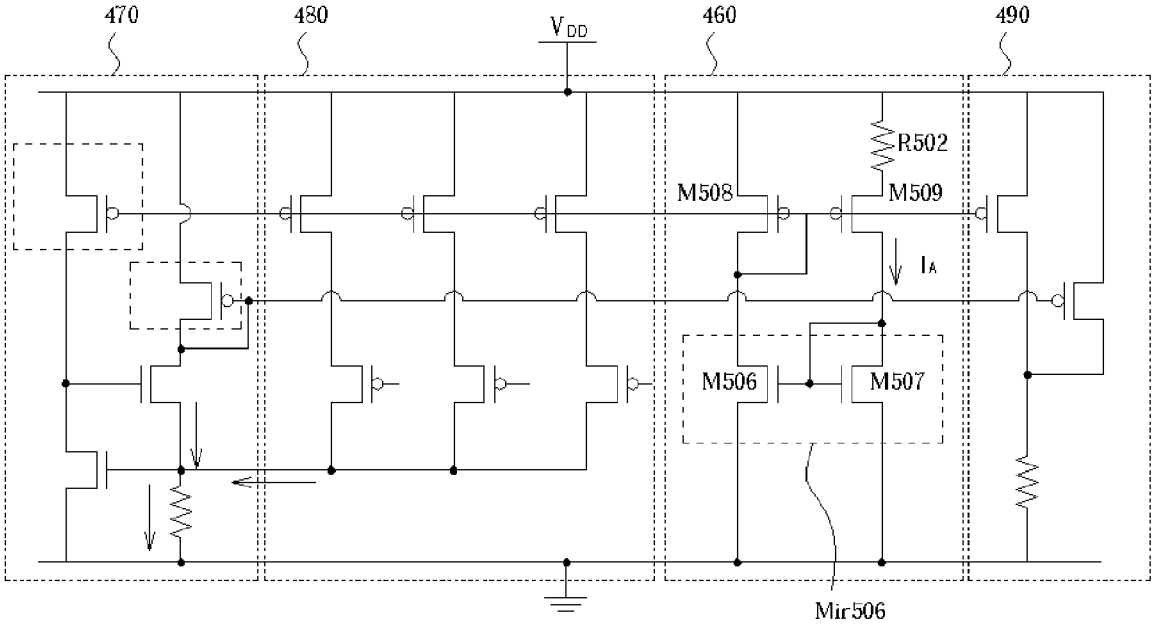
FIG. 15 illustrates another embodiment of the voltage generator according to the present invention.

Please refer to FIG. 15. FIG. 15 illustrates another embodiment of the voltage generator according to the present invention. The embodiment in FIG. 15 is similar to the embodiment in FIG. 11, wherein the voltage generator comprises a positive temperature coefficient current generating circuit 460, a negative temperature coefficient current generating circuit 470, a current fine-tune circuit 480, and a voltage outputting circuit 490. However, the positive temperature coefficient current generating circuits in FIG. 15 and FIG. 11 are different. The positive temperature coefficient current generating circuit 460 similar to the positive temperature coefficient current generating circuit 260 in FIG. 13 comprises a PMOS M508, a PMOS M509, a resistor R502, and a current mirror Mir506. As shown in FIG. 15, The source and the gate of PMOS M508 and M509 are connected together. The source of MOS 508 is connected to the power supply $V_{DD}$. The source of PMOS M509 is connected to the power supply $V_{DD}$ through resistor R502. Both the PMOS M508 and M509 operate in the sub-threshold region, the output current $I_A$ of the positive temperature coefficient is generated by the drain of PMOS M509. The current mirror Mir506 comprises NMOS M506 and M507, which mirror the output current $I_A$ with some multiple to other blocks of the voltage generator.

Figure 16:
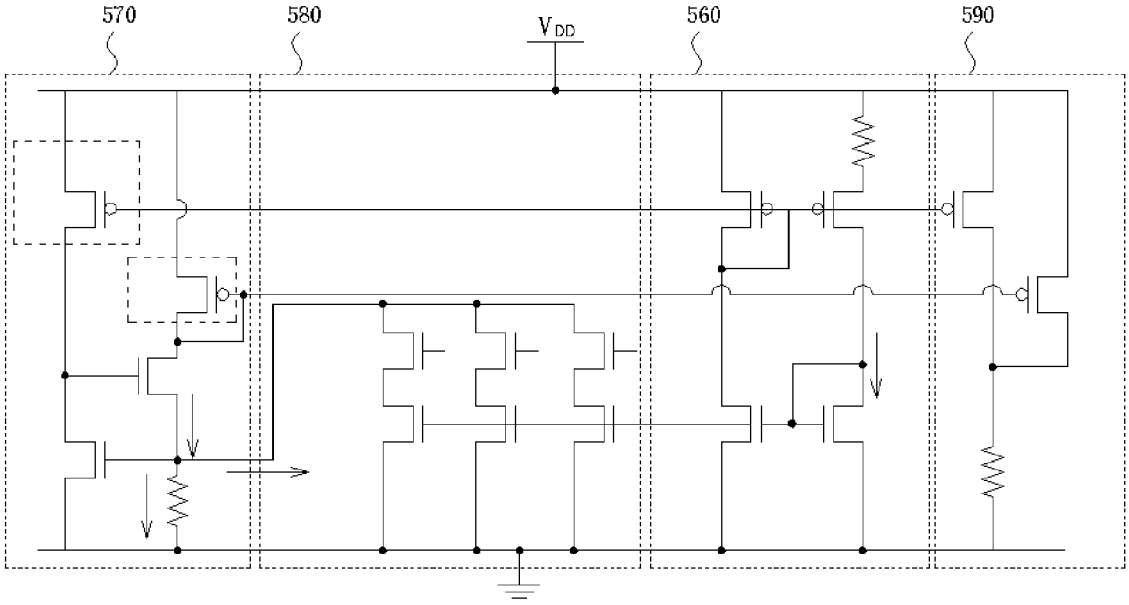
FIG. 16 illustrates another embodiment of the voltage generator according to the present invention.

Please refer to FIG. 16. FIG. 16 illustrates another embodiment of the voltage generator according to the present invention. The voltage generator comprises a positive temperature coefficient current generating circuit 560, a negative temperature coefficient current generating circuit 570, a current fine-tune circuit 580, and a voltage outputting circuit 590. The embodiment in FIG. 16 is similar to that in FIG. 15, but the current fine-tune circuit 580 is different. In this embodiment, the principle of the current fine-tune circuit 580 is the same with the current fine-tune circuit 180 in FIG. 12, i.e. to fine increase the output current of the negative temperature coefficient current generating circuit.

Figure 17:
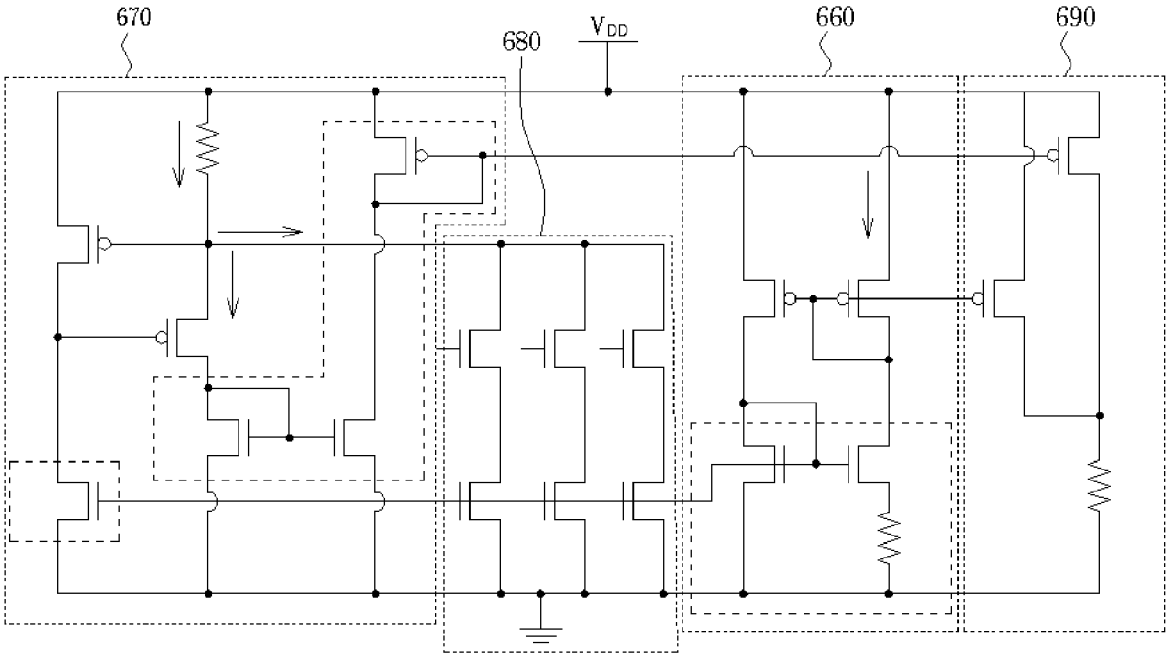
FIG. 17 illustrates another embodiment of the voltage generator according to the present invention.

Please refer to FIG. 17. FIG. 17 illustrates another embodiment of the voltage generator according to the present invention. The voltage generator comprises a positive temperature coefficient current generating circuit 660, a negative temperature coefficient current generating circuit 670, a current fine-tune circuit 680, and a voltage outputting circuit 690. The embodiment in FIG. 17 is similar to that in FIG. 13, but the positive temperature coefficient current generating circuit 660 is different. The positive temperature coefficient current generating circuit 660 in FIG. 17 is the same as that in FIG. 12.

Figure 18:
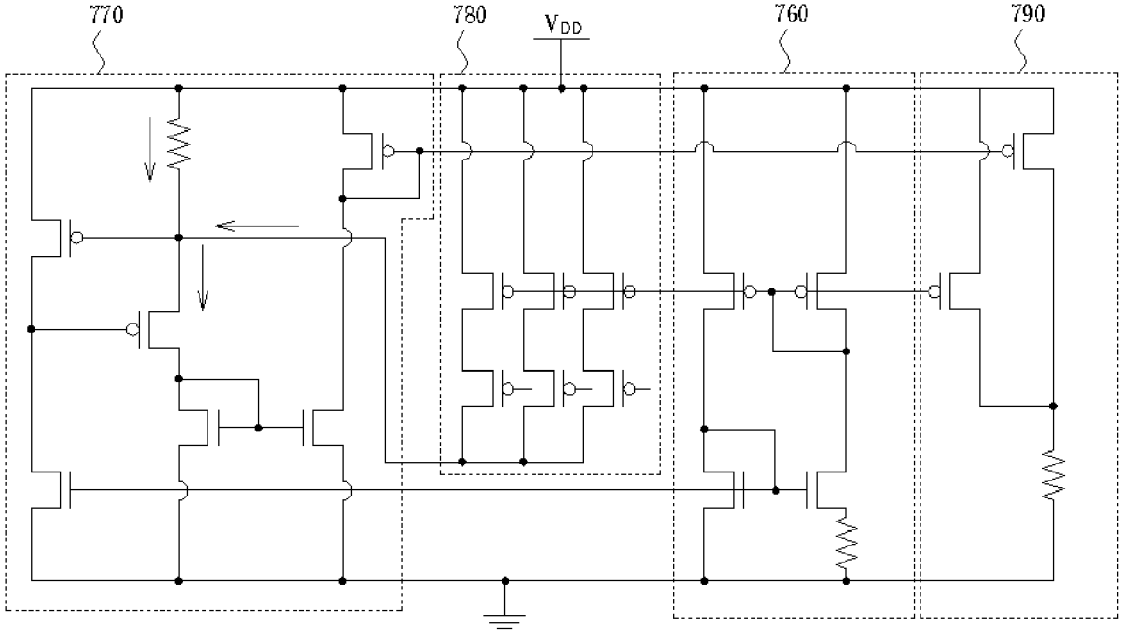
FIG. 18 illustrates another embodiment of the voltage generator according to the present invention.

Please refer to FIG. 18. FIG. 18 illustrates another embodiment of the voltage generator according to the present invention. The voltage generator comprises a positive temperature coefficient current generating circuit 760, a negative temperature coefficient current generating circuit 770, a current fine-tune circuit 780, and a voltage outputting circuit 790. This embodiment is similar to that in FIG. 17, but the current fine-tune circuit 780 is different. The principle of the current fine-tune circuit 780 is the same as the current fine-tune circuit 80 in FIG. 11, i.e. to fine increase the output current of the negative temperature coefficient current generating circuit.

In the prior art, diodes and an amplifier are specially arranged to compensate a current of a positive temperature coefficient and a current of a negative temperature coefficient so that the output of the amplifier obtains a reference voltage regulated against variation of the ambient temperature. However, the prior art cannot satisfy the demand for lower costs and lower voltage output power supplies in the modern electronics market. In another prior art, the characteristic of a MOS device operating in the sub-threshold region is utilized to implement a voltage generator, but the output reference voltage of the chip of the voltage generator often deviates from the designed value due to process variation. Compared to the prior art, the voltage generator of the present invention takes advantages of CMOS technology to generate a current of a positive temperature coefficient and a current of a negative temperature coefficient by operating MOS devices in the sub-threshold region. Moreover, a mechanism to fine-tune the current of the negative temperature coefficient is included. Therefore, the present invention has the advantages of low production cost, stable output voltage of a voltage generator regulated against process variation and changes in ambient temperature.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A voltage generator, comprising:

a positive temperature coefficient current generating module, wherein an output current of the positive temperature coefficient current generating module increases with a rising ambient temperature;

a negative temperature coefficient current generating module wherein an output current of the negative temperature coefficient current generating module decreases with a rising ambient temperature;

a current fine-tune module used for adjusting the output current of the negative temperature coefficient current generating module; and a voltage output module, connected to the positive temperature coefficient current generating module and the negative temperature coefficient current generating module for generating an output voltage according to the positive temperature coefficient current generating module and the negative temperature coefficient current generating module.

2. The voltage generator in claim 1 wherein the current fine-tune module is connected to the negative temperature coefficient current generating module for effecting fine increases in the output current of the negative temperature coefficient current generating module.

3. The voltage generator in claim 1 wherein the current fine-tune module is connected to the negative temperature coefficient current generating module for effecting fine decreases in the output current of the negative temperature coefficient current generating module.

4. The voltage generator in claim 1 wherein the current fine-tune module comprises a fine-tune unit.

5. A voltage generator, comprising:

a positive temperature coefficient current generating circuit, which comprises a first NMOS device, a second NMOS device, a resistor, and a current mirror, a gate of the first NMOS device being connected to a drain of the first NMOS device and a gate of the second NMOS device, a source of the first NMOS device being connected to ground, a source of the second NMOS device being connected to ground through the resistor, the drain of the first NMOS device and a drain of the second NMOS device being connected to the current mirror, the current mirror being used for mirroring a current through the resistor generating an output current;

a negative temperature coefficient current generating circuit comprising a first NMOS device, a second NMOS device, a resistor, and a current mirror, a gate of the first NMOS device being connected to ground through the resistor, a source of the first NMOS device being connected to ground, a drain of the first NMOS device being connected to the current mirror of the positive temperature coefficient current generating module, a source of the second NMOS device being connected to the gate of the first NMOS device, a gate of the second NMOS device being connected to the drain of the first NMOS device, a drain of the second NMOS device being connected to the current mirror of the negative temperature coefficient current generating module for mirroring a current through the second NMOS device to generate an output current; and a voltage outputting circuit, connected to the positive and the negative temperature coefficient current generating circuits for generating an output voltage according to the output currents of the positive and the negative temperature coefficient current generating circuits.

6. The voltage generator in claim 5 further comprising a current fine-tune circuit, the current fine-tune circuit being connected to the negative temperature coefficient current generating circuit for fine increasing or decreasing of the output current of the negative temperature coefficient current generating module.

7. A voltage generating method comprising operate the second NMOS device of the positive temperature coefficient current generating circuit and the first NMOS device of the negative temperature coefficient current generating circuit in the sub-threshold region so that the voltage outputting circuit of claim 5 is able to generate a stable output voltage.

8. A voltage generator, comprising:

a positive temperature coefficient current generating circuit comprising a first PMOS device, a second PMOS device, a resistor and a current mirror, a gate of the first PMOS device is connected to a drain of the first PMOS device and a gate of the second PMOS device, a source of the first PMOS device is connected to a power supply, the source of the second PMOS device being connected to the power supply through the resistor, the drains of the first and the second PMOS devices being connected to the current mirror, the current mirror being used for mirroring a current through the resistor generating an output current;

a negative temperature coefficient current generating circuit comprising a first PMOS device, a second PMOS device, a resistor, and a current mirror, a gate of the first PMOS device being connected to the power supply through the resistor, a source of the first PMOS device being connected to the power supply, a drain of the first PMOS device being connected to the current mirror of the positive temperature coefficient current generating module, a source of the second PMOS device being connected to the gate of the first PMOS device, a gate of the second PMOS device being connected to the drain of the first PMOS device, a drain of the second PMOS device being connected to the current mirror of the negative temperature coefficient current generating module for mirroring a current through the second PMOS device to generate an output current; and a voltage outputting circuit, connected to the positive and the negative temperature coefficient current generating circuits for generating an output voltage according to the output currents of the positive and the negative temperature coefficient current generating circuits.

9. The voltage generator in claim 8 further comprising a current fine-tune circuit, the current fine-tune circuit being connected to the negative temperature coefficient current generating circuit for fine increasing or decreasing of the output current of the negative temperature coefficient current generating module.

10. A voltage generating method comprising operate the second PMOS device of the positive temperature coefficient current generating circuit and the first PMOS device of the negative temperature coefficient current generating circuit in the sub-threshold region so that the voltage outputting circuit of claim 8 is able to generate a stable output voltage.

11. A voltage generator, comprising:

a positive temperature coefficient current generating circuit comprising a first PMOS device, a second PMOS device, a resistor and a current mirror, a gate of the first PMOS device is connected to a drain of the first PMOS device and a gate of the second PMOS device, a source of the first PMOS device is connected to a power supply, the source of the second PMOS device being connected to the power supply through the resistor, the drains of the first and the second PMOS devices being connected to the current mirror, the current mirror being used for mirror a current through the resistor generating an output current;

a negative temperature coefficient current generating circuit comprising a first NMOS device, a second NMOS device, a resistor, and a current mirror, a gate of the first NMOS device being connected to ground through the resistor, a source of the first NMOS device being connected to ground, a drain of the first NMOS device being connected to the current mirror of the positive temperature coefficient current generating module, a source of the second NMOS device being connected to the gate of the first NMOS device, a gate of the second NMOS device being connected to the drain of the first NMOS device, a drain of the second NMOS device being connected to the current mirror of the negative temperature coefficient current generating module for mirroring a current through the second NMOS device to generate an output current; and a voltage outputting circuit, connected to the positive and the negative temperature coefficient current generating circuits for generating an output voltage according to the output currents of the positive and the negative temperature coefficient current generating circuits.

12. The voltage generator in claim 11 further comprising a current fine-tune circuit, the current fine-tune circuit being connected to the negative temperature coefficient current generating circuit for fine increasing or decreasing of the output current of the negative temperature coefficient current generating module.

13. A voltage generating method comprising operate the second PMOS device of the positive temperature coefficient current generating circuit and the first NMOS device of the negative temperature coefficient current generating circuit in the sub-threshold region so that the voltage outputting circuit of claim 11 is able to generate a stable output voltage.

14. A voltage generator, comprising:

a positive temperature coefficient current generating circuit, which comprises a first NMOS device, a second NMOS device, a resistor, and a current mirror, a gate of the first NMOS device being connected to a drain of the first NMOS device and a gate of the second NMOS device, a source of the first NMOS device being connected to ground, a source of the second NMOS device being connected to ground through the resistor, the drain of the first NMOS device and a drain of the second NMOS device being connected to the current mirror, the current mirror being used for mirror a current through the resistor generating an output current;

a negative temperature coefficient current generating circuit comprising a first PMOS device, a second PMOS device, a resistor, and a current mirror, a gate of the first PMOS device being connected to the power supply through the resistor, a source of the first PMOS device being connected to the power supply, a drain of the first PMOS device being connected to the current mirror of the positive temperature coefficient current generating module, a source of the second PMOS device being connected to the gate of the first PMOS device, a gate of the second PMOS device being connected to the drain of the first PMOS device, a drain of the second PMOS device being connected to the current mirror of the negative temperature coefficient current generating module for mirroring a current through the second PMOS device to generate an output current; and a voltage outputting circuit, connected to the positive and the negative temperature coefficient current generating circuits for generating an output voltage according to the output currents of the positive and the negative temperature coefficient current generating circuits.

15. The voltage generator in claim 14 further comprising a current fine-tune circuit, the current fine-tune circuit being connected to the negative temperature coefficient current generating circuit for fine increasing or decreasing the output current of the negative temperature coefficient current generating module.

16. A voltage generating method comprising operating the second NMOS device of the positive temperature coefficient current generating circuit and the first PMOS device of the negative temperature coefficient current generating circuit in the sub-threshold region so that the voltage outputting circuit in claim 14 is able to generate a stable output voltage.

* * * * *